United States Patent [19]

Strangfeld

[11] Patent Number: 4,662,395

[45] Date of Patent: May 5, 1987

[54] PRESSURIZED LIQUID FLUSHING VALVE ARRANGEMENT WITH A SHUT-OFF SLEEVE

[75] Inventor: Reiner Strangfeld, Buckeburg, Fed. Rep. of Germany

[73] Assignee: Georg Rost & Söhne Armaturenfabrik GmbH & Co. KG, Westfalica, Fed. Rep. of Germany

[21] Appl. No.: 915,293

[22] Filed: Oct. 6, 1986

[30] Foreign Application Priority Data

Oct. 17, 1985 [DE] Fed. Rep. of Germany ..... 3536947

[51] Int. Cl.[4] ..... F16K 31/12

[52] U.S. Cl. ..... 137/614.19; 251/38; 251/43; 251/291; 251/340; 251/346

[58] Field of Search ..... 137/613, 614.19; 251/38, 43, 52, 291, 340, 346, 347

[56] References Cited

U.S. PATENT DOCUMENTS 599,462 2/1898 Van Shaik ..... 251/38
747,468 12/1903 Nethery ..... 251/38
2,874,931 2/1959 Baker et al. ..... 251/346

FOREIGN PATENT DOCUMENTS 277097 10/1922 Fed. Rep. of Germany ..... 251/38

*Primary Examiner*—A. Michael Chambers
*Attorney, Agent, or Firm*—Erwin S. Teltscher

[57] ABSTRACT

A flushing valve arrangement for controlling the flow of a pressurized flushing liquid includes a housing unit including an inlet and an outlet for the flushing liquid and a housing which bounds a flow passage that connects the inlet with the outlet. The housing is outwardly spaced from the outlet to bound therewith an annular channel which surrounds the outlet and opens into a communication region of the flow passage. A flushing valve unit is interposed in the flow passage downstream of the communication region and controls the flow of the flushing liquid from the inlet to the outlet. An externally actuatable shut-off valve unit is integrated into the arrangement and includes a shut-off sleeve surrounding the outlet and movable into and out of the annular channel toward and away from its closing position in which it extends into the communication region of the flow path and prevents the flushing liquid from flowing from the inlet toward the flushing valve unit. The shut-off valve component is thus functionally independent of the operating parts of the valve arrangement. The flushing valve arrangement can be constructed as an angular fixture.

8 Claims, 1 Drawing Figure

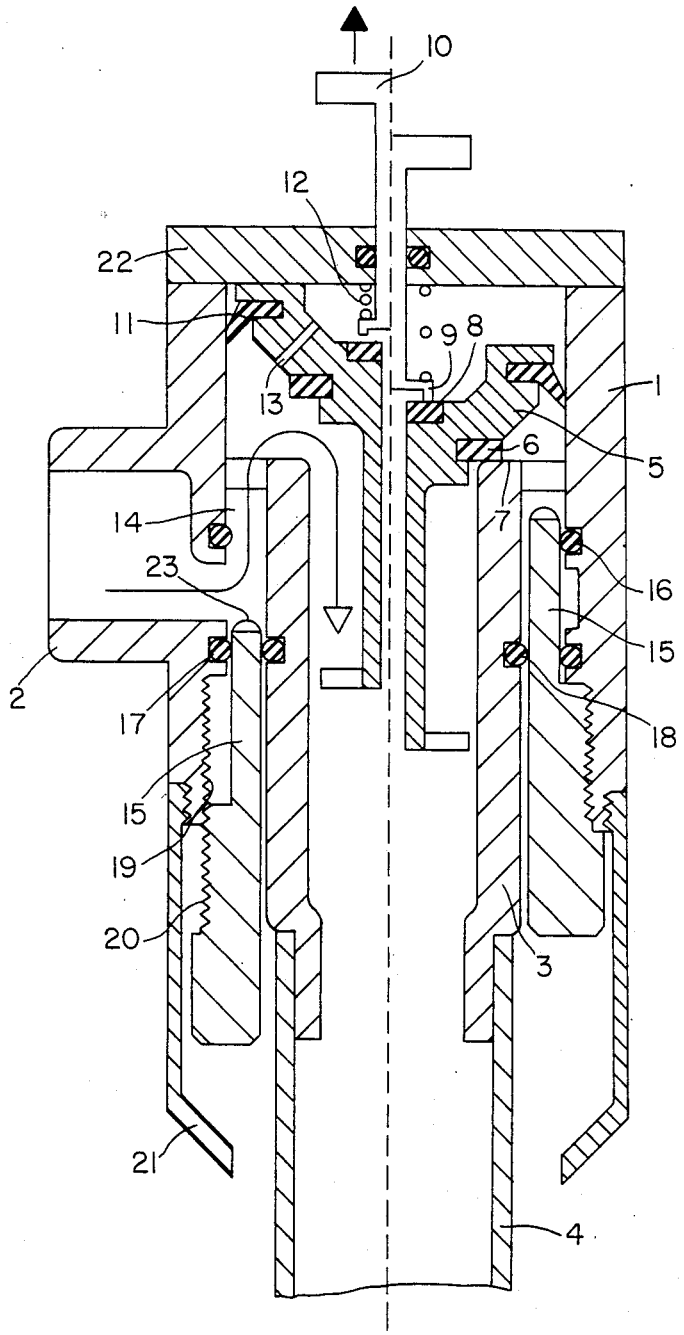
10
12
22
11
9
8
13
1
6
5
14
7
23
16
15
2
17
18
15
19
20
3
21
4

PRESSURIZED LIQUID FLUSHING VALVE ARRANGEMENT WITH A SHUT-OFF SLEEVE

BACKGROUND OF THE INVENTION

The present invention relates to flushing valves in general, and more particularly to a flushing valve arrangement which is equipped with an integrated shut-off valve.

There are already known various constructions of flushing valve arrangements of the above type. Such arrangements typically include a water inlet, a water outlet, a housing which bounds a flow passage connecting the water inlet with the water outlet, and a flushing valve unit which is arranged in the flow passage.

In one valve arrangement of this type which is known from the German Patent DE-PS No. 26 03 776, the piston which forms, together with a valve seat, the flushing valve is removably received in a cylinder and is guided in the cylinder for movement. This cylinder has an open side which is surrounded by a rim portion. The cylinder, in turn, can be pressed with its rim portion against a counterbearing which is provided in the flushing valve arrangement housing and which sealingly surrounds the valve seat, in order to achieve a shutting-off action. While it is true that the shutting-off action is integrated in this manner in the flushing valve arrangement, the construction principle embodied in this known construction can be nevertheless employed only in a flow-through fixture in which the water inlet and the water outlet extend in the same direction.

Moreover, the shutting-off action achieved in this known construction is not independent of the operating parts of the fixture so that, on the one hand, there exists the requirement that, after the performance of the shutting-off operation, the positions of the operating parts of the flushing valve arrangement which have been acted upon and displaced during such operation be again adjusted very accurately. Then, when maintenance operations and/or repairs are to be performed, for example, on the cylinder here under consideration itself, the shutting-off action cannot even be effectuated in such a case.

On the other hand, there are also known and in widespread use such flushing valve arrangements which utilize so-called angular fittings or fixtures, in which the water inlet extends substantially perpendicularly to the water outlet. In such known angular fixtures, angular valve shut-off devices separate from the flushing valve arrangement itself are provided. The provision of such separate shut-off devices not only necessitates a considerable additional expenditure, but also results in an esthetically unappealing appearance of the overall installation. Additionally, an eccentric arrangement of the water supply is required in such constructions.

SUMMARY OF THE INVENTION

Accordingly, it is a general object of the present invention to avoid the disadvantages of the prior art.

More particularly, it is an object of the present invention to provide a flushing valve arrangement which does not possess the drawbacks of the known arrangements of this type.

Still another object of the present invention is to devise a flushing valve arrangement of the type here under consideration which incorporates an integrated shut-off valve that is fully independent of the operating parts of the remainder of the flushing valve fixture.

It is yet another object of the present invention to design the above arrangement in such a manner as to be able to embody the concepts revealed herein even in an angular fixture.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a flushing valve arrangement for controlling the flow of a pressurized flushing liquid, this arrangement comprising housing means including an inlet and an outlet for the flushing liquid and a housing bounding a flow passage connecting the inlet with the outlet, the housing being outwardly spaced from the outlet to bound therewith an annular channel which surrounds the outlet and opens into a communication region of the flow passage. Flushing valve means is interposed in the flow passage downstream of the communication region and is operative for controlling the flow of the flushing liquid from the inlet to the outlet. Externally actuatable shut-off valve means is integrated into the arrangement and includes a shut-off sleeve surrounding the outlet and movable into and out of the annular channel toward and away from a closing position thereof in which it extends into the region of the flow path and prevents the flushing liquid from flowing from the inlet toward the flushing valve means.

It is particularly advantageous when the inlet has an open end which opens into the annular channel at the communication region and the annular channel extends at least downwardly from the communication region in a position of use of the arrangement and accommodates at least a portion of the shut-off sleeve, and when there are further provided at least two seals arranged in the annular channel downwardly of the open end of the inlet at opposite sides of the shut-off sleeve and operative for sealing respective gaps between the shut-off sleeve, the housing and the outlet. Then, the arrangement may further comprise means for moving the shut-off sleeve toward and away from the closing position thereof, such moving means being advantageously arranged at a zone of the arrangement which is separated by at least one of the seals from the flow of the flushing liquid.

According to another advantageous aspect of the present invention, there is further provided means for moving the shut-off sleeve toward and away from the closing position thereof, including interengaging threaded portions on the housing and on the shut-off sleeve.

The inlet has an open end which opens into the annular channel at the communication region and the annular channel extends at least downwardly from the region in a position of use of the arrangement and accommodates at least a portion of the shut-off sleeve. The arrangement of the present invention advantageously further comprises at least one seal arranged in the annular channel upwardly of the open end of the inlet and sealingly engaging the shut-off sleeve in the closing position of the shut-off sleeve. Even the outlet extends at least downwardly from the communication region in the position of use and has an upper end portion which is provided with a valve seat; then, at least the upper end portion of the outlet is advantageously provided as a structural element separate from the housing and mounted in the housing in such a manner as to internally bound the annular channel. The shut-off sleeve also extends at least downwardly from the communication region in the position of use and has a lower end portion which extends downwardly beyond the housing; it is then advantageous when there is provided a covering sleeve which is dismountably connected with the housing and covers the lower end portion of the shut-off sleeve. Last but not least, it is advantageous when the shut-off sleeve has an upper end face which is provided with a comb-like tooth formation.

As a result of the provision of the annular channel which concentrically surrounds the water outlet and of the closure of the annular channel in the sense of the aforementioned shutting-off action by the shut-off sleeve which also concentrically surrounds the water outlet, wherein the shutting-off of the annular channel takes place upstream from the flushing valve of the fixture, there is achieved the desired complete independence of the shut-off operation from the remaining parts of the fixture. The structural layout is suited with respect to the position and the configuration of the annular channel even for pressurized liquid flushing valve arrangements having the shape of angular fixtures. Herein, the arrangement of the shut-off sleeve concentrically around the water outlet has the particular advantage that the shut-off sleeve has a relatively large outer diameter so that, as a result, it is possible to achieve adjustment of the position of the shut-off sleeve even manually when a corresponding tool is not available.

The shut-off arrangement as a whole is structurally very simple. Despite good integration of the shut-off arrangement into the pressurized liquid flushing valve arrangement, the dimensions of the flushing valve arrangement are not increased to any significant extent.

BRIEF DESCRIPTION OF THE DRAWING

The present invention will be described below in more detail with reference to the sole FIGURE of the accompanying drawing which is an axial sectional view of a pressurized liquid flushing valve arrangement of the present invention shown in its closed condition in the right-hand half and in its open condition in the left-hand half of the drawing.

DETAILED DESCRIPTION OF THE PREFERRED EMBODIMENT

Referring now to the sole FIGURE of the drawing in detail, it may be seen that the reference numeral 1 has been used therein to identify a housing of a flushing valve arrangement of the present invention which controls the flow of a pressurized flushing liquid, such as water. The upper end of the housing 1 includes a lid 22 which is removable from the remainder of the housing 1. The illustrated flushing valve arrangement is constructed as an angular fixture or fitting; accordingly, the housing 1 includes a laterally arranged water inlet 2. Furthermore, a water outlet 3 is arranged in the housing 1. The water outlet 3 extends substantially perpendicularly to and downwardly from the water inlet 2 and its lower end is connected to a flushing pipe 4 which leads to a toilet bowl or to another equipment to be flushed.

A valve piston 5 is arranged in the interior of the housing 1. The valve piston 5 is interposed in the flow-conducting connection between the water inlet 2 and the water outlet 3 and is axially slidable in the housing 1. The valve piston 5 is equipped with a seal 6 which defines, together with a seat 7 that is provided at an end face of the water outlet 3, a main valve of the pressurized liquid flushing valve arrangement. The valve piston 5 further carries another seal 8 which defines, together with a disk 9 which is arranged at a lower region of an actuating element 10, an auxiliary valve of the pressurized liquid flushing valve arrangement. The valve piston 5 also carries a lip seal element 11 which sealingly contacts the housing 1. The main and auxiliary valves are shown at the right-hand half of the sole FIGURE of the drawing in their closed conditions.

The pressurized liquid flushing valve arrangement is opened during normal operation by lifting the actuating element 10, that is, by displacing the actuating element 10 upwardly in the direction indicated by an arrow, against the force exerted by a compression spring 12. As a result of this displacement, the auxiliary valve opens and the water present upwardly of the valve piston 5 is enabled to flow through a central bore of the valve piston 5 to the water outlet 3. As a result of the pressure relationships which have changed after the opening of the auxiliary valve, even the valve piston 5 is lifted off the seat 7, so that the main valve opens rather rapidly. The open positions of the various operating parts of the fixture are illustrated at the left-hand half of the sole FIGURE of the drawing.

After the termination of the actuating operation, the compression spring 12 closes the auxiliary valve. Thereupon, water flows through an equalization nozzle 13, which has a relatively small flow-through cross-sectional area, into the space situated above the valve piston 5. The valve piston 5 then moves at a correspondingly reduced speed in the direction toward the seat 7, until the main valve is closed by the sealing engagement of the seal 6 with the seat 7. The closed positions of the various operating parts of the fixture are illustrated at the right-hand half of the sole FIGURE of the drawing.

For the formation of an integrated shut-off valve in the above-discussed pressurized liquid flushing valve arrangement, an annular channel 14 is disposed in the connecting flow path between the water inlet 2 and the water outlet 3. More particularly, the annular channel 14 is arranged upstream of the main valve as considered in the water flow direction and concentrically surrounds the upper end of the water outlet 3. In the illustrated embodiment of the present invention, the housing 1 is shown to be of one piece with the water inlet 2 and the water outlet 3. However, for manufacturing reasons, it may be very much simpler to make especially the entire water outlet 3, but at least its upper portion which is provided with the seat 7, as a structural part which is separate from the housing 1 and which is then mounted in the housing 1 while leaving the annular channel 14.

Now, regardless of whether the entire water outlet 3 or at least its upper portion is integral with or separate from the housing 1, a shut-off sleeve 15 which concentrically surrounds the water outlet 3 can be introduced from below into the annular channel 14 in a closing sense into its shut-off position. In the illustrated construction, a seal 16 is provided for this reason in the annular channel 14 upwardly of an open end of the water inlet 2 which opens into the annular channel 14. In the closed position of the shut-off sleeve 15 which is illustrated in the right-hand half of the sole FIGURE of the drawing, the seal 16 is active toward the operating parts of the fixture. Two seals 17 and 18 are provided below the open end of the water inlet 2. These seals 17 and 18 are associated with the annular channel 14 and are arranged at opposite sides of the shut-off sleeve 15 to seal respective gaps between the shut-off sleeve 15, the housing 1, and the water outlet 3, and thus to prevent water from escaping out of the housing 1 through such gaps.

In the illustrated exemplary construction, a threaded portion 19 is provided in the housing 1, while a corresponding threaded portion 20 is provided on the shut-off sleeve 15. Consequently, the shut-off sleeve 15 can be threaded into and out of the housing 1, the threading of the shut-off sleeve 15 into the housing 1 progressively displacing the shut-off sleeve 15 into the channel 14 and thus toward the closed position of the shut-off sleeve 15. The threaded portions 19 and 20 are situated outside the flow path region of the water and they are sealingly separated from such flow path region by the seals 17 and 18.

Engagement surfaces for an actuating tool are provided at the lower end of the shut-off sleeve 15. However, due to the concentric arrangement of the shut-off sleeve 15 around the water outlet 3, the dimensions of the shut-off sleeve 15 are relatively so large that it is possible to turn the shut-off sleeve 15 manually, without the use of any actuating tool.

Comb-like teeth 23 are arranged at the upper end face of the shut-off sleeve 15. The provision of the teeth 23 is particularly advantageous when the closing action of the shut-off sleeve 15 is to be used for throttling excessively high flushing flows. The teeth 23 subdivide the flow through the then relatively narrow throttling gap into a plurality of partial streams. This contributes to the low noise level of the armature during its flushing operation.

In the illustrated exemplary construction of the flushing valve arrangement of the present invention, the lower part of the shut-off sleeve 15 which projects out of the housing 1 is covered for optical reasons by a covering sleeve or rosette 21 which, in the illustrated construction, is threaded onto the housing 1.

It may be seen from the above explanation that the shut-off sleeve 15 operates fully independently of the operating parts of the pressurized liquid flushing valve arrangement, that is, especially of the valve piston 5 and of the actuating element 10. After the closing of the shut-off sleeve 15 and after or concurrently with the removal of the removable lid 22, these operating parts can be removed in a simple manner from the housing 1.

While the present invention has been described and illustrated herein as embodied in a specific construction of a flushing valve arrangement for toilets, it is not limited to the details of this particular construction, since various modifications and structural changes are possible and contemplated by the present invention. Thus, the scope of the present invention will be determined exclusively by the appended claims.

What is claimed is:

1. A flushing valve arrangement for controlling the flow of a pressurized flushing liquid, comprising housing means including an inlet and an outlet for the flushing liquid and a housing bounding a flow passage connecting said inlet with said outlet, said housing being outwardly spaced from said outlet to bound therewith an annular channel which surrounds said outlet and opens into a region of said flow passage;

flushing valve means interposed in said flow passage downstream of said region and operative for controlling the flow of the flushing liquid from said inlet to said outlet; and externally actuatable shut-off valve means integrated into the arrangement and including a shut-off sleeve surrounding said outlet and movable into and out of said annular channel toward and away from a closing position thereof in which it extends into said region of said flow path and prevents the flushing liquid from flowing from said inlet toward said flushing valve means.

2. The arrangement as defined in claim 1, wherein said inlet has an open end which opens into said annular channel at said region and said annular channel extends at least downwardly from said region in a position of use of the arrangement and accommodates at least a portion of said shut-off sleeve; and further comprising at least two seals arranged in said annular channel downwardly of said open end of said inlet at opposite sides of said shut-off sleeve and operative for sealing respective gaps between said shut-off sleeve, said housing and said outlet.

3. The arrangement as defined in claim 2, and further comprising means for moving said shut-off sleeve toward and away from said closing position thereof, said moving means being arranged at a zone of the arrangement which is separated by at least one of said seals from the flow of the flushing liquid.

4. The arrangement as defined in claim 1, and further comprising means for moving said shut-off sleeve toward and away from said closing position thereof, including interengaging threaded portions on said housing and on said shut-off sleeve.

5. The arrangement as defined in claim 1, wherein said inlet has an open end which opens into said annular channel at said region and said annular channel extends at least downwardly from said region in a position of use of the arrangement and accommodates at least a portion of said shut-off sleeve; and further comprising at least one seal arranged in said annular channel upwardly of said open end of said inlet and sealingly engaging said shut-off sleeve in said closing position of said shut-off sleeve.

6. The arrangement as defined in claim 1, wherein said outlet extends at least downwardly from said region in a position of use of the arrangement and has an upper end portion which includes a valve seat; and wherein at least said upper end portion of said outlet is a structural element separate from said housing and mounted in said housing in such a manner as to internally bound said annular channel.

7. The arrangement as defined in claim 1, wherein said shut-off sleeve extends at least downwardly from said region in a position of use of the arrangement and has a lower end portion which extends downwardly beyond said housing; and further comprising a covering sleeve which is dismountably connected with said housing and covers said lower end portion of said shut-off sleeve.

8. The arrangement as defined in claim 1, wherein said shut-off sleeve extends at least downwardly from said region in a position of use of the arrangement and has an upper end face which is provided with a comb-like tooth formation.

* * * * *